US006917253B2

(12) United States Patent
Rumold et al.

(10) Patent No.: US 6,917,253 B2
(45) Date of Patent: Jul. 12, 2005

(54) RADIO-FREQUENCY CONNECTION AND A RADIO-FREQUENCY DISTRIBUTION NETWORK

(75) Inventors: Jürgen Rumold, Bad Endorf (DE); Roland Gabriel, Griesstatt (DE); Stefan Berger, Rohrdorf (DE)

(73) Assignee: Kathrein-Werke KG, Rosenheim (DE)

( * ) Notice: Subject to any disclaimer, the term of this patent is extended or adjusted under 35 U.S.C. 154(b) by 0 days.

(21) Appl. No.: 10/455,794

(22) Filed: Jun. 6, 2003

(65) Prior Publication Data

US 2004/0178860 A1 Sep. 16, 2004

(30) Foreign Application Priority Data

Mar. 13, 2003 (DE) ..... 103 11 041

(51) Int. Cl.[7] ..... H01P 5/00
(52) U.S. Cl. ..... 333/24 C; 333/260
(58) Field of Search ..... 333/260, 4, 5, 333/24 C, 25, 26, 33, 246, 254; 439/98, 498, 579, 580; 343/798, 800

(56) References Cited

U.S. PATENT DOCUMENTS

| | | | | |
|---|---|---|---|---|
| 5,138,436 A | * | 8/1992 | Koepf | 257/728 |
| 5,554,038 A | * | 9/1996 | Morlion et al. | 439/108 |
| 5,757,246 A | | 5/1998 | Johnson | 333/12 |
| 5,812,037 A | | 9/1998 | Block | 333/204 |
| 5,929,822 A | | 7/1999 | Kumpfbeck et al. | 343/795 |
| 5,936,841 A | | 8/1999 | Kantner et al. | 361/737 |
| 5,986,519 A | | 11/1999 | Kellett et al. | 333/120 |
| 6,250,936 B1 | * | 6/2001 | Armistead et al. | 439/98 |
| 6,336,827 B1 | * | 1/2002 | Akama et al. | 439/610 |
| 6,396,264 B1 | * | 5/2002 | Tamaki et al. | 324/249 |
| 6,414,636 B1 | | 7/2002 | Godard et al. | 343/700 MS |
| 6,463,303 B1 | | 10/2002 | Zhao | 455/562.1 |

FOREIGN PATENT DOCUMENTS

| | | | |
|---|---|---|---|
| DE | 198 52 175 A1 | 5/2000 | H05K/7/02 |
| JP | 04234203 A | 8/1992 | H01P/5/08 |
| WO | WO 01/59876 A1 | 8/2001 | H01Q/1/24 |

OTHER PUBLICATIONS

Khattab et al., "Principles of Low PIM Hardware Design," Proceedings of the Thirteenth National Radio Science Conference, Cairo, Egypt (Mar. 19–21, 1996).

* cited by examiner

*Primary Examiner*—Dean Takaoka
(74) *Attorney, Agent, or Firm*—Nixon & Vanderhye P.C.

(57) ABSTRACT

An improved radio-frequency or network connection including a basic module having two or more basic signal coupling surfaces, and a network module having two or more network signal coupling surfaces. The basic module has a basic ground coupling surface, and the network module has a network ground coupling surface. In the operating state, the basic ground coupling surface is capacitively RF coupled to the network ground coupling surface, and is aligned parallel thereto.

21 Claims, 8 Drawing Sheets

RADIO-FREQUENCY CONNECTION AND A RADIO-FREQUENCY DISTRIBUTION NETWORK

CROSS-REFERENCES TO RELATED APPLICATIONS

Not applicable

STATEMENT REGARDING FEDERALLY SPONSORED RESEARCH OR DEVELOPMENT

Not applicable.

FIELD

The technology herein relates to a radio-frequency connection and to a radio-frequency distribution network.

BACKGROUND AND SUMMARY

Particularly for antenna design purposes—but not only there—difficulties in some cases occur in providing links or connections without any intermodulation. This problem occurs in particular at interfaces to which different assemblies are intended to be connected, as required.

Radio-frequency connections between two radio-frequency assemblies, for example between a radio-frequency board and a wire-free transmission device, for example antennas, are normally provided by means of coaxial connection techniques. However, disadvantageous and undesirable intermodulation can also occur here. Improvements to avoid or to reduce passive intermodulation when using coaxial plug connections have been proposed, by way of example, in U.S. Pat. No. 6,414,636 B1. However, if the aim, for example, is to connect a specific distribution network for a so-called smart antenna, as is known in principle from U.S. Pat. No 6,463,303 B1, in order to produce a specific polar diagram characteristic for the antenna under discussion, then the costs for a module which can be connected in such a way furthermore also rise considerably if all the connections on the input and output side are in the form of coaxial plug connections.

Thus, in principle, it would also be possible to provide capacitive connections instead of coaxial plug connections.

Capacitive RF connections have been disclosed, for example, in U.S. Pat. No. 5,812,037. These have a stripline filter coupling structure, which operates capacitively.

A PCMCIA signal connector, as is normally used for Notebook Computers, has in principle been disclosed in U.S. Pat. No. 5,936,841. The PCMCIA plug-in board normally has a male connector strip on one of its end faces, which interacts with a male connector strip which is integrated in the Notebook, when the corresponding PCMCIA board is inserted into a holding slot in the Notebook. A first electrically conductive layer, which represents one half of the RF coupling device, is then provided on one of the large side surfaces, parallel to this side surface. The second electrically conductive layer, which is parallel to the first, is accommodated with a lateral offset in the interior of the apparatus. There is an air gap (resulting from the lateral distance between the PCMCIA board and the adjacent inner boundary surface of the plug-in slot for the electrical apparatus, for example in the form of Notebook) and dielectric intermediate layer, which is part of the wall of the Notebook, between the two conductive layers of the RF coupling structure which are parallel to one another.

However, the undesirable intermodulation cannot be avoided even by means of a capacitive RF connection for a PCMCIA board such as this.

The object of the exemplary illustrative non-limiting technology described herein is thus to produce a radio-frequency connection and, in particular, a radio-frequency distribution network, which can be connected as required to an interface that is provided, with the aim of largely avoiding or precluding intermodulation.

The production of a floating radio-frequency connection at an appropriate interface allows a modular link without any intermodulation, for example between an RF network and a basic module. In this case, not only the signal lines which carry the signal but also the outer conductors or earth conductors are capacitively connected to one another at the corresponding contact devices, while avoiding any conductive contact. The nature of the interface in the form of the capacitive coupling via an interface with contacts has the major advantage of a low level of intermodulation, as is actually of major importance for mobile radio applications, such as mobile radio antennas. If very strong intermodulation products occur in the transmission frequency band, and whose frequencies extend into the reception frequency band, it would no longer be possible for mobile devices such as mobile telephones to receive weak signals at these reception frequencies.

The fact that a modular link between an RF network having two or more connections or connecting points to an RF device, for example a mobile radio antenna, can be achieved without any intermodulation on the basis of this principle is in this case surprising for a number of reasons. This is because it would necessarily have been presumed that, when forming corresponding coupling surfaces running parallel to one another and on which the respective RF signal is intended to be transmitted, or else for producing the floating earth connection, further influences would be noticeable which would make it impossible to produce an RF coupling connection which could always be reproduced unambiguously. This is also due to the fact that, especially when using mobile radio antennas or transmission antennas, it is absolutely essential to use a metallic housing for screening purposes. However, metallic housings fundamentally have effects on the electrical conditions and characteristics if capacitive coupling devices are used in the interior of the screened housing. This is because, in some circumstances, the distance between the coupling surfaces and the screening housing results in an additional parasitic parallel capacitance between the coupling surfaces and the electrical earth.

However, an exemplary illustrative non-limiting design of the RF connecting device also makes it possible to minimize these effects and influences.

The geometry of the coupling surfaces governs the electrical parameters for signal transmission, such as the matching to the characteristic impedance (VSWR), the insertion loss and the bandwidth of the frequency band. In order to improve fine tuning further, one preferred development of the exemplary illustrative non-limiting implementation also provides, for example, for the coupling surface on a board that is used to be provided with "small tabs" or so-called "extension surfaces", which project at the sides. These small tabs or extension surfaces, in parallel with the coupling between the coupling surfaces, produce an additional small amount of coupling between the coupling surfaces on a board and an earth surface.

The exemplary illustrative non-limiting network module, which can be coupled to a basic module, furthermore has capacitively coupled earth surfaces, in addition to the coupling surfaces which provide capacitive RF coupling, in order to suppress the intermodulation-free modular link. This metal structure, which covers the board, is preferably formed on the face on which the corresponding electrical earth surfaces of the basic module are located. In this case, an insulating film with a predefined thickness is preferably used for insulation between the two electrical earth surfaces which produce the earth coupling. The coupling surfaces of the electrical earth surfaces which provide the signal transmission and which in some cases are also referred to in the following text as coupling fingers are in contrast to this preferably formed on the opposite face of the board of the network module, so that the substrate of the board acts as insulation for the corresponding signal coupling surface on the basic module.

The radio-frequency network on said board may, for example, be based on stripline technology (microstrip technology).

BRIEF DESCRIPTION OF THE DRAWINGS

These and other features and advantages will be better and more completely understood by referring to the following detailed description of exemplary non-limiting illustrative implementations in conjunction with the drawings of which.

DETAILED DESCRIPTION

Figure 1:
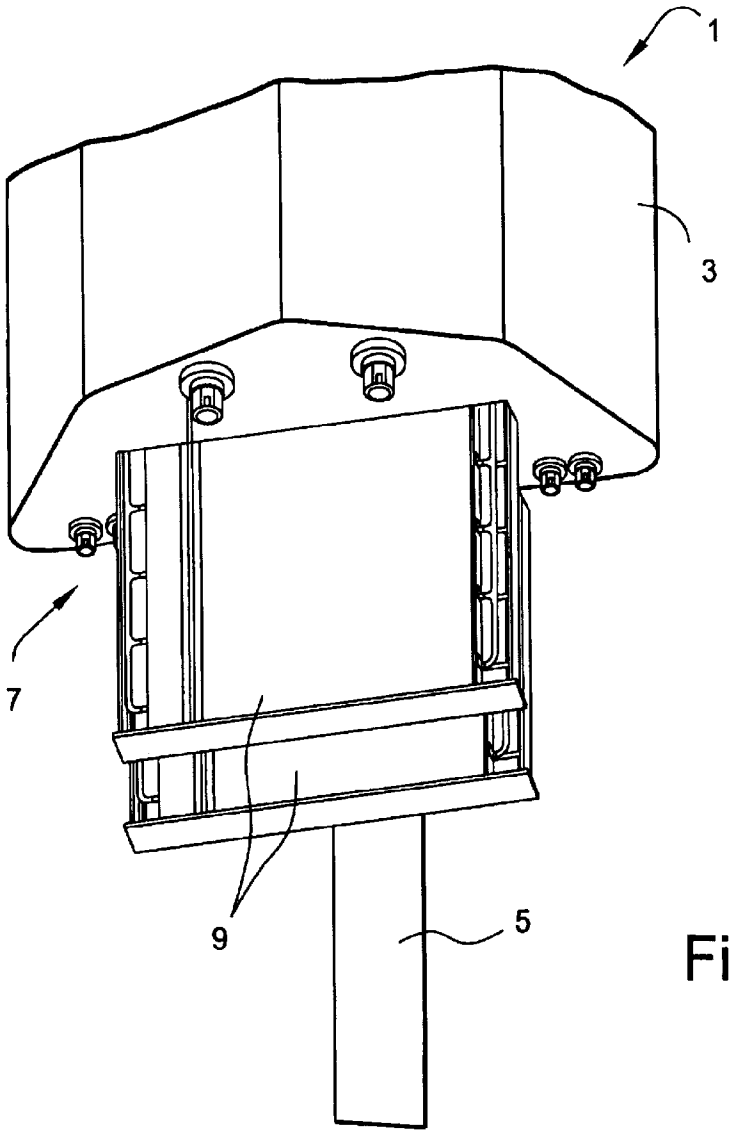
FIG. 1 shows a schematic perspective partial view of an exemplary illustrative non-limiting mobile radio antenna with two basic module devices which can be plugged in and withdrawn on the lower face, and which are each suitable for holding one network module.

FIG. 1 shows a schematic perspective illustration, in the form of an extract, of a mobile radio antenna 1, of a base station. This extract shows the housing cover of the antenna device, namely the so-called radon 3. Overall, the antenna is held in position via an antenna mast 5. A slotted opening is provided on the lower face 7 of the housing cover 3, into which two basic modules 9 can be pushed, parallel and independently of one another, and which each interact with two interchangeable network modules 11.

Specific network components and network circuits, for example based on stripline technology, are provided on the network modules 11 so that the use of an appropriately matched network module 11 results in the antenna having a specific polar diagram characteristic. The explained network modules 11 are thus used to produce a specific polar diagram characteristic for a so-called smart antenna, as is described, by way of example, in the U.S. Pat. No. 6,463,303 B1 or in the PCT publication WO 01/59 876 A1. For example, it is thus possible to use one module for transmission and reception in a first polarization direction, and the second module for reception and for transmission in a second polarization direction. However, the modules may also be used for transmission in different frequency bands. It is also possible, for example, to use two modules in such a way that one module is used for transmission and the other for reception. Depending on the requirements, two or more basic modules and associated network modules may thus also be provided in one antenna.

Figure 2:
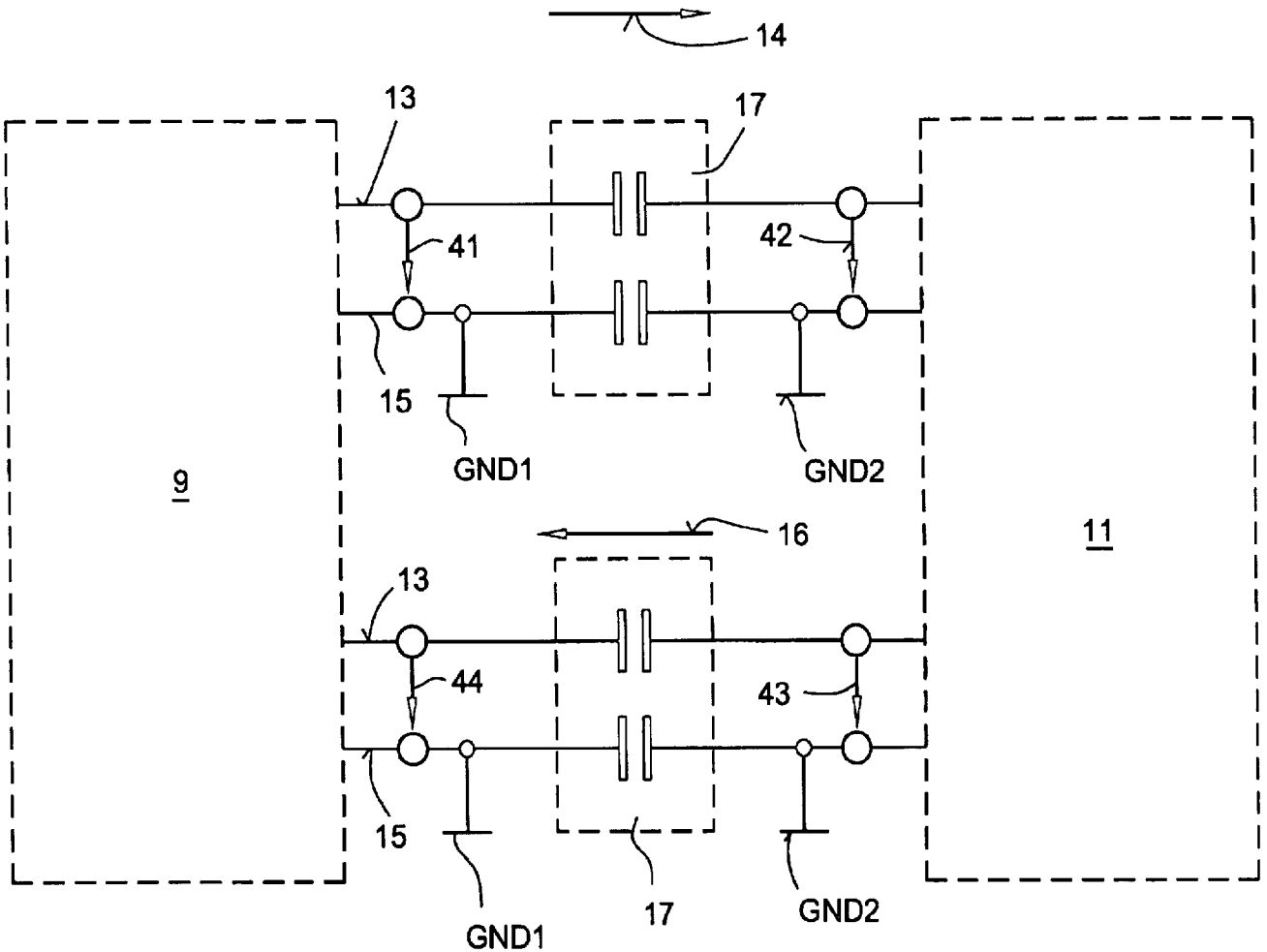
FIG. 2 shows a schematic illustration of an exemplary basic design of the basic module and of the network module, producing a floating RF connection.

FIG. 2 shows a schematic configuration of an interacting pair of modules, to be precise with a basic module 9 and a network module 11. Just two signal lines 13 and two earth lines 15 are in this case used to show how the respective network module 11 is coupled in a completely floating manner via an appropriate RF connection 17 to the relevant basic module 9.

The respective earth potential GND1 is in this case applied only to the basic module 9, and the earth potential GND2 is applied only to the network module. In this case, appropriate floating connections are provided between the basic module 9 and the network module 11 via one or more signal paths 14 and 16.

Figure 3:
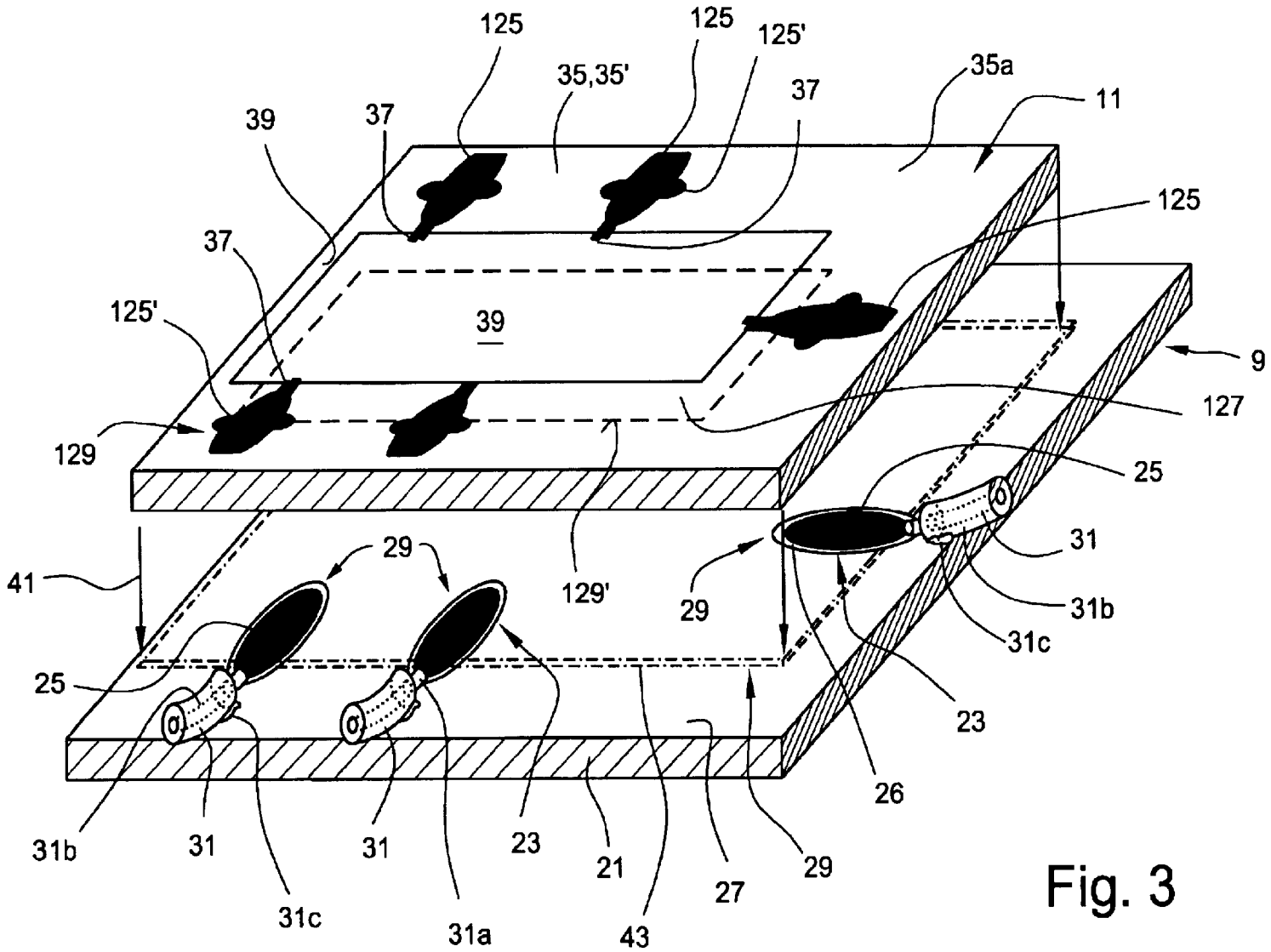
FIG. 3 shows a schematic perspective illustration of an exemplary basic module and of the network module, in order to explain the floating RF coupling.
Figure 4:
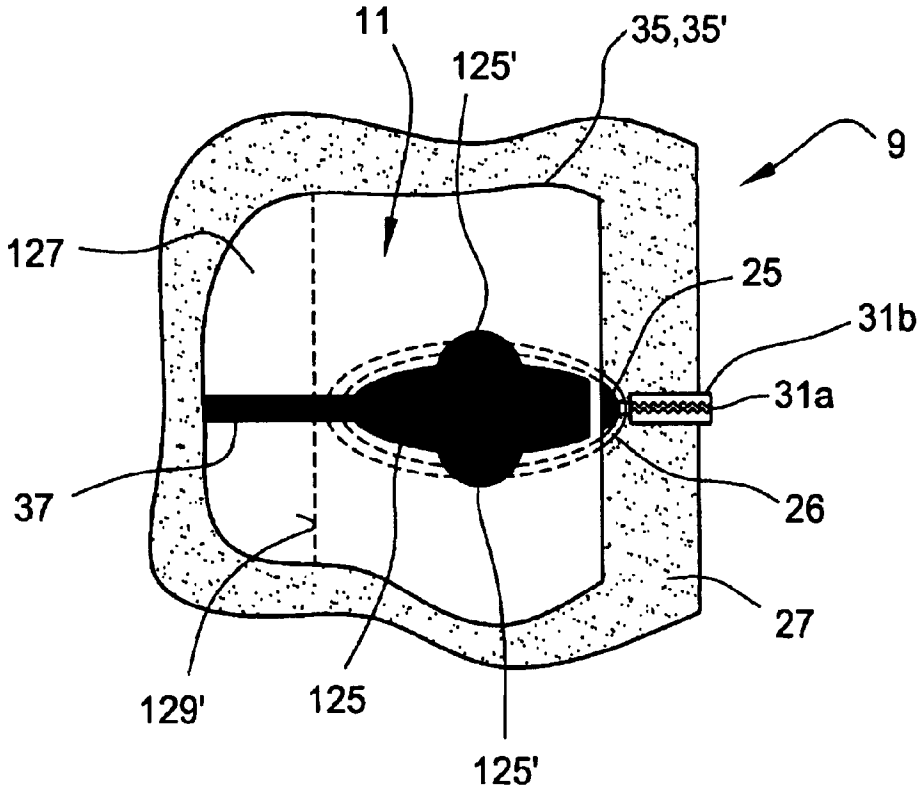
FIG. 4 shows a schematic plan view, in the form of an extract, of interacting coupling surfaces on the basic module and on the network module.

FIG. 3 and FIG. 4 will now be used to describe the schematic basic configuration of the two modules in greater detail.

In principle, the basic module 9 comprises an electrically screened base plate or base 21, which is generally composed completely of metal. This electrically conductive base 21 is provided with recesses or windows 23, in which electrically conductive basic signal coupling surfaces 25 are formed. These basic signal coupling surfaces 25 are isolated from the electrically conductive base 21 by means of in each case one circumferential gap 26, or some other isolation, with the electrically conductive base 21 forming a basic earth coupling surface 27 adjacent to the basic signal coupling surface 25. In the exemplary illustrative non-limiting arrangement illustrated in FIG. 3, three connection points 29 are shown on the base, to each of which a coaxial conductor 31 leads, with the inner conductor 31*a* of each coaxial conductor 31 being soldered to the basic signal coupling surface 25, and the associated outer conductor 31*b* being electrically conductively connected, by means of a stripped area on the outer circumference, via a corresponding soldered joint 31*c* to the basic earth coupling surface 27.

The corresponding network module 11 has a board 35 with an associated substrate 35', on which connection points 129, which correspond to the base, are formed on the network module 11 via the connection points 29.

The connection points 129 on the network module 11 comprise network signal coupling surfaces 125 which, in the illustrated exemplary illustrative non-limiting arrangement, likewise have a rectangular shape, that is to say they are comparable to the respective shape of the basic signal coupling surfaces 25.

The network signal coupling surface 125 is connected via a respective stripline 37 to a network 39, which is indicated only schematically in FIG. 3 and represents an RF assembly. This is preferably provided and formed on the top face 35*a* of the board 35, that is to say on the face of the board 35 that is opposite the base which interacts in this way.

Furthermore, the network module 11 also has a large-area earth coupling surface, namely a network earth coupling surface 127, which, in the illustrated exemplary implementation, is, however, not on the same side of the board 35 on which the connection points 129 are also provided, but is formed on its lower face. In the illustrated exemplary non-limiting implementation, the electrically conductive network earth surface 127 is at least approximately rectangular in shape, and its circumferential boundary line 129' extends into the immediate vicinity of the connection points 129. During operation, the board 35 is moved towards the base as indicated by the arrows 41, and is positioned, to be precise with the interposition of an electrically insulating intermediate layer, preferably in the form of an insulating film 43, whose size and shape correspond to or are slightly larger than the network earth coupling surface 127. This means that there is no possibility of the network earth coupling surface 127 making contact with the basic earth coupling surface 27, producing an electrically conductive connection. The use of an insulating film 43 with a predetermined thickness also produces a precisely defined separation between the basic earth coupling surface 27 and the network earth coupling surface 127, so that clearly reproducible electrical conditions can be produced.

FIG. 4 shows a schematic plan view corresponding to the layers of the earth coupling surfaces and of the insulating film, as well as of the network earth coupling surface 127 in relationship to the basic earth coupling surface 27 which is located underneath it. This also shows that the basic earth coupling surface 27 may, for example, be designed to be physically larger both in the longitudinal direction and in the transverse direction than that in the network earth coupling surface 127. For fine tuning, provision is also made in this case for the network coupling surfaces 127 to have the capability to be provided with small tabs or extension sections 127' which project at the sides, with this resulting, in the illustrated exemplary illustrative non-limiting implementation, in a cruciform structure, although this is not absolutely essential. These small tabs or extension sections 125' provide an additional small amount of coupling between the coupling surfaces 125 on the board 35 and the basic earth coupling surface 27, in parallel with the coupling between the coupling surfaces 25, 125. The reason for this is the short distance between these small tabs or extension sections 127' and the basic earth coupling surface 27 compared with the distance between the network signal coupling surface 125 and the basic earth coupling surface 27.

In the assembled position, in which, as explained, the board 35 rests on the base 21, the desired clear relationships are reproduced. This can be produced, for example, by means of a sliding mechanism which allows the network module 11 together with the board 35 to be moved to the desired clear relative position with respect to the basic module 9, and to be held and to be fixed in this position.

Figure 5:
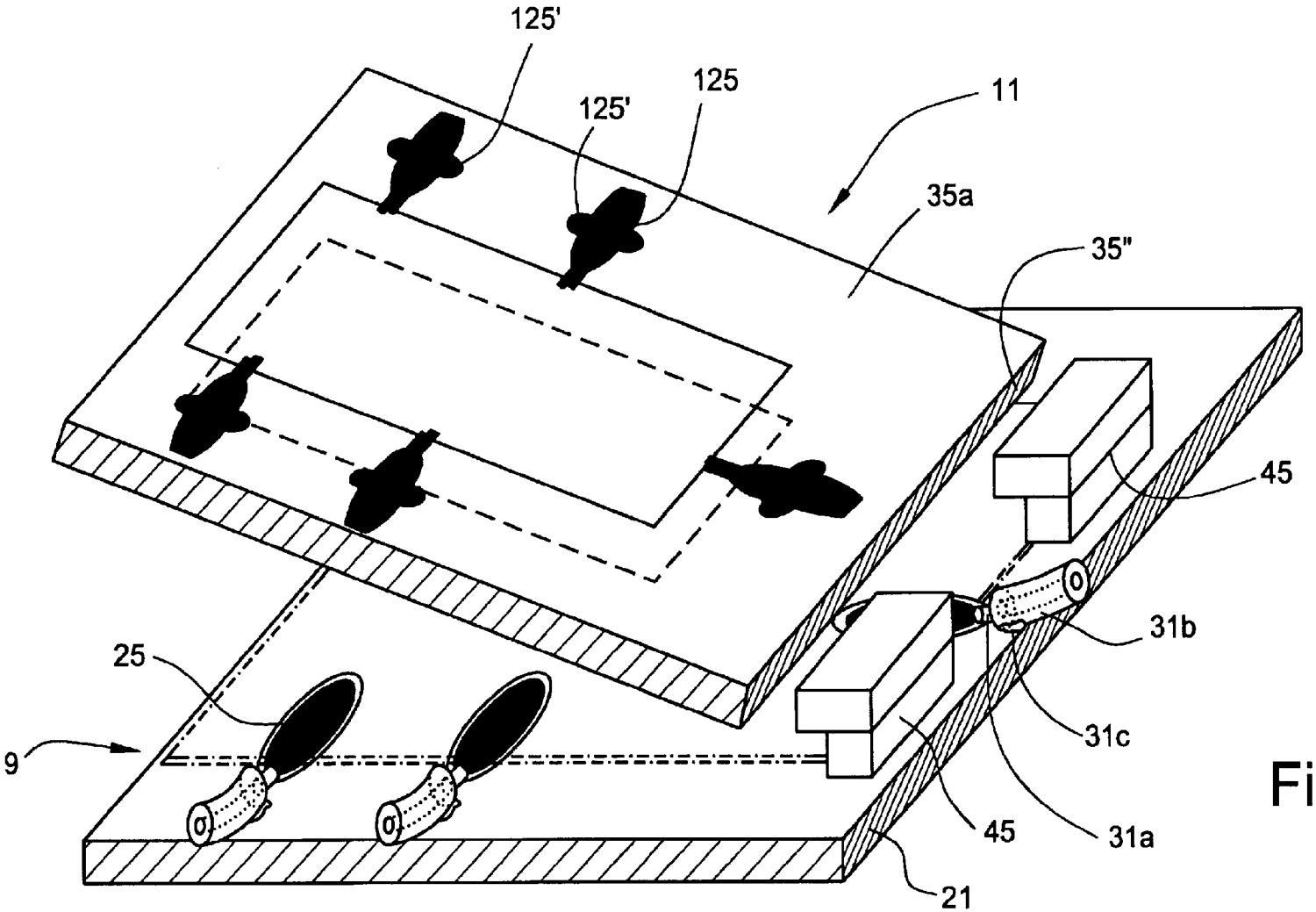
FIG. 5 shows an illustration, corresponding to FIG. 3, in order to explain a different connection mechanism between the two modules.

FIG. 5 will be used only to show that, for example, a type of tilting mechanism can also be provided instead of a sliding mechanism (which, for example, has two groove holders on opposite sides, into which the board 35 can be pushed). A tilting holder 45 which, schematically, is in the form of a U-shaped recess is used in the exemplary illustrative non-limiting implementation shown in FIG. 5, into which one boundary edge 35" of the board 35 is pushed, so that the board 35 can then be pivoted about the tilting axis formed in this way onto the base 21, until the board 35 is resting on the base 21 with the insulating film 43 which has been mentioned being positioned between them.

Figure 6:
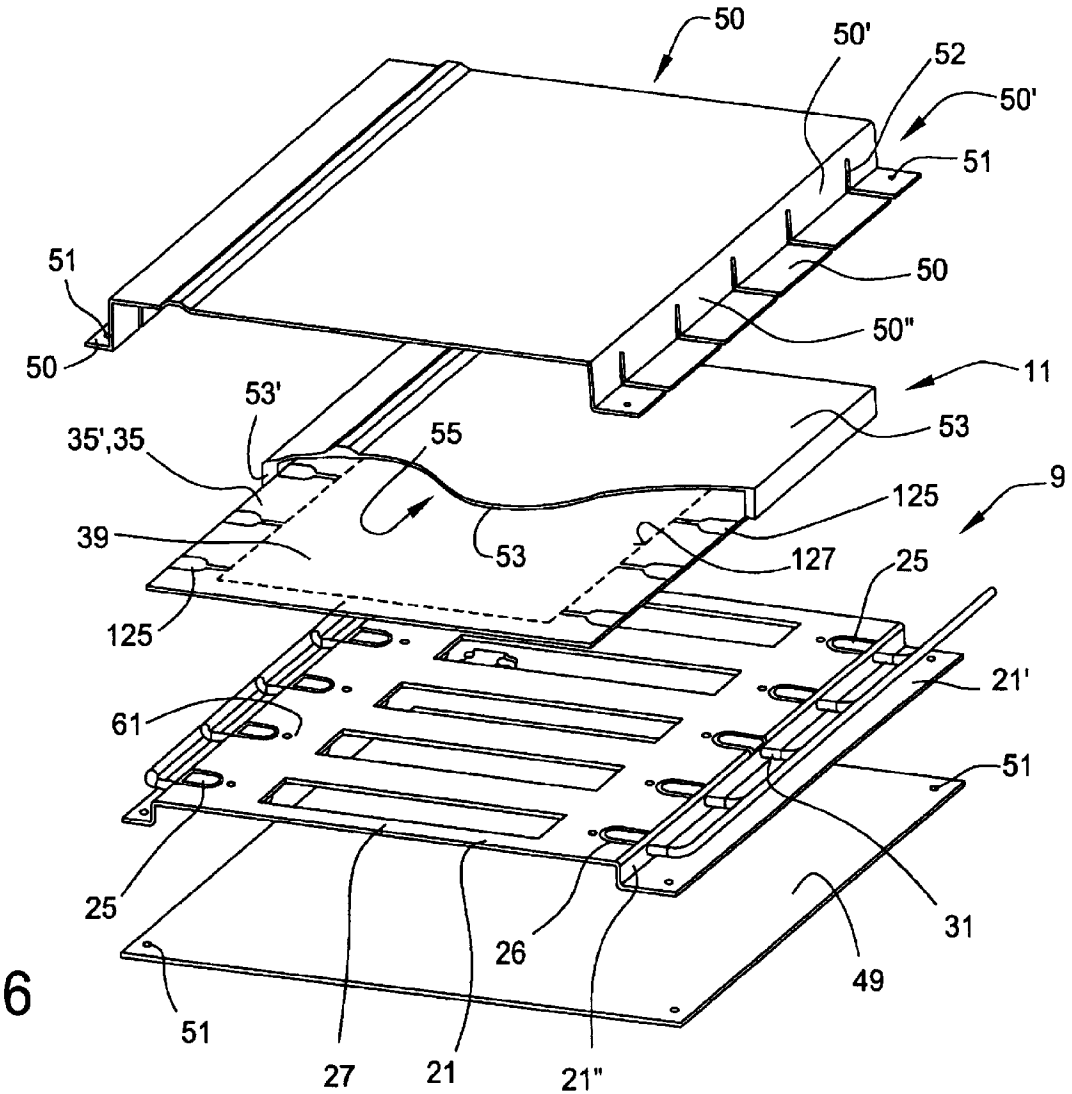
FIG. 6 shows a schematic perspective illustration, in the form of an extract, of an exemplary basic module and of a network module, as an exploded view.
Figure 7:
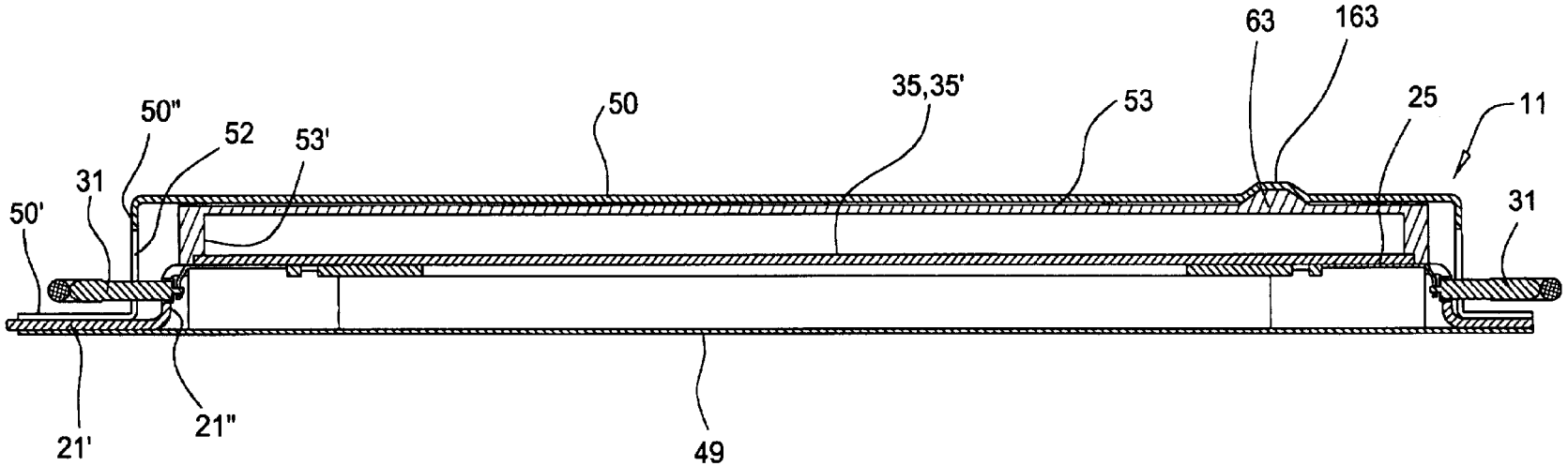
FIG. 7 shows a schematic cross-sectional illustration through the exemplary implementation shown in FIG. 5, in the assembled state.
Figure 8:
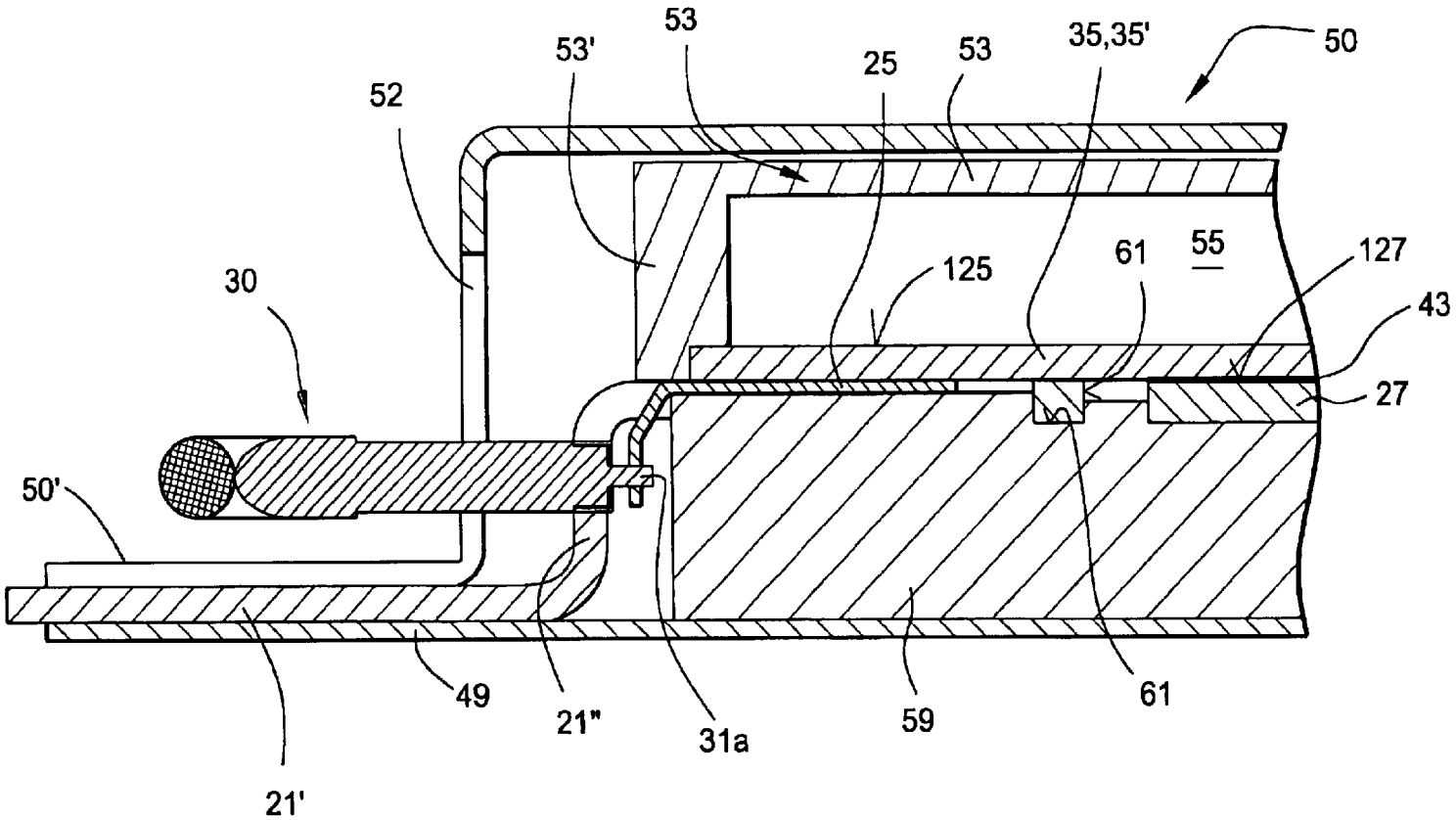
FIG. 8 shows an enlarged detail illustration from the cross-sectional illustration shown in FIG. 6.

FIGS. 6 to 8 will now be used to explain one possible configuration of the basic module 9 and of the network module 11 with further details, although the fundamental principle remains unchanged.

In the exemplary illustrative non-limiting arrangement shown in FIGS. 6 to 8, the base 21 is formed with a cross section in the form of a U-shaped electrically conductive metal sheet, which is short in height and is provided with flanges 21' on opposite sides.

One or more coaxial cables 31 are fed to the basic module 9 from each side in the area of the flange sections 21', with the individual coaxial conductor sections or coaxial conductors 31 being passed to the basic signal coupling surfaces 25, as already explained. The outer conductor 31*b* of each coaxial conductor 31 in this case makes electrical contact with the electrically conductive base 21 on the side limbs of the U-shaped base 21, for example by means of an electrical soldered joint, with the inner conductors 31*a* of the coaxial conductors 31 passing through these side sections 21" and being soldered to the respective basic signal coupling surfaces 25 via an electrical soldered joint.

These basic signal coupling surfaces 25 are electrically isolated from the basic earth coupling surface 27 by means of a circumferential isolating gap 26. In other words, the basic signal coupling surfaces 25 are formed in an appropriately physically large window 23, so that the isolating gap 26 is formed between the basic signal coupling surfaces 25 and the basic earth coupling surfaces 27.

Finally, a screening wall 49 is provided on the lower face of the base 21, in order to produce an overall screen. A further screening wall 50 is fitted from above onto the basic module 9 formed in this way, as part of this basic module 9, and these items can then be screwed to one another by the use of screws in holes 51. The upper screening wall 50 in this case likewise has a U-shaped cross section with projecting flange sections 50' and side limbs 50", with corresponding slotted recesses 52 being incorporated in the vertical limb section 50' in the area of the supplied coaxial cables and coaxial conductors 31.

The basic module 9 that has been explained is thus used for holding a network module 11, which is illustrated in exploded form in FIG. 6.

In addition to the already explained board 35 and the network 39 located on it, the network module 11 also has a surrounding housing 53, whose wall sections 53' are seated on the external circumference of the board 35 and are connected to it, to be precise producing an internal area 55 in which, as explained, the appropriate assemblies and cables for producing the network 39 can be formed and provided on the board 35.

The cross-sectional illustration shows that the network signal coupling surfaces 125 are located directly above the basic signal coupling surfaces 25, with the material of the printed circuit board, that is to say the substrate 35', forming the insulation between the network signal coupling surface 125 and the basic signal coupling surface 25. The basic signal coupling surfaces 25 are in this case electrically conductively connected via a connection section 25', which runs downward, to the inner conductor 31*a*, which projects on it, of an associated coaxial conductor 31, for example via a soldered joint.

As can also be seen from the cross-sectional illustration, an electrically insulating support 59, which is shown in FIGS. 7 and 8 and is in the form of a spacer, is also provided, on which on the one hand the electrical earth, that is to say the basic earth coupling surface 27, rests, and on the other hand the basic signal coupling surface 25 also rests. Since the signal coupling surface 25 has a thinner material cross section than the basic earth coupling surface 27, the said spacer 59 is thus designed in a stepped form. In order to ensure a unique adjustment seating, recesses or, for example, holes 61 are provided, located offset directly inwards, with respect to the boundary edge of the window-like recesses or of the isolating gap 26, in which the spacer 59 projects into this recess or hole 61, with a section 59' which projects slightly further upwards.

A network module 11 formed in this way may thus be pushed into the associated basic module 9, for example at the end, without any problems, in which case, for insertion of the network module 11 (housing cover 50) in the correct position, not only does the network module 11 have a projection 163 at an asymmetric point, for example on the top face, which interacts with a corresponding projection or recess 63 on the inside of the housing cover of the basic module 9 (FIG. 6).

While the technology herein has been described in connection with exemplary illustrative non-limiting implementations, the invention is not to be limited by the disclosure. The invention is intended to be defined by the claims and to cover all corresponding and equivalent arrangements whether or not specifically disclosed herein.

What is claimed is:

1. A radio frequency connection comprising:

a network module having plural network signal coupling surfaces and a network ground coupling surface, a basic module having plural basic signal coupling surfaces and a basic ground coupling surface, the network module being positioned with respect to the basic module such that a capacitive RF signal connection is produced via the at least one network signal coupling surface and at least one basic signal coupling surface positioned parallel thereto, wherein in the operating state, the basic ground coupling surface is coupled—in a floating manner—to the network ground coupling surface, and is aligned parallel thereto.

2. The RF connection according to claim 1, wherein the basic module includes a base having a top face, the basic signal coupling surfaces being formed on the top face of the base on the basic module, and wherein the network module includes a board with a substrate, the board having a side facing away from the basic signal coupling surfaces, the network signal coupling surfaces being formed on the board parallel and adjacent to the basic signal coupling surfaces, and provided on the side of the board facing away from the basic signal coupling surfaces.

3. The RF connection according to claim 1, wherein the network ground coupling surface on the board or on the substrate is provided on the side opposite the network signal coupling surfaces.

4. The RF connection according to claim 1, wherein the base of the basic module rests on a support or on a spacer which is provided at least in the area of the basic signal coupling surfaces.

5. The RF connection according to claim 4, further including a positioning device provided in the form of recesses and projections which engage in one another, via which the support or the supporting holder positioned in an exact relative position with respect to the basic signal coupling surface or the basic ground coupling surface, respectively.

6. The RF connection according to claim 1, wherein the basic signal coupling surfaces are each electrically connected to an inner conductor of a coaxial conductor, via a soldered joint.

7. The RF connection according to claim 6, wherein the basic signal coupling surfaces have a connecting section, which is routed on a lower level and extends at least to the height of an inner conductor, which projects axially from a coaxial conductor, forming a soldered joint.

8. The RF connection according to claim 1, wherein the basic module has a lower insulating cover and a housing cover which projects at a distance above it and is preferably provided with two opposite flange sections, the edge of the cover and the area of the flange sections of the housing cover being connected to one another and holding a flange section, which is located between them, of the base.

9. The RF connection according to claim 1, wherein the network module has a surrounding housing which is seated on the edge of the board, and/or is connected to it, forming an internal area.

10. The RF connection according to claim 1, wherein the material of the basic signal coupling surfaces is thinner than the material of the basic ground coupling surface.

11. The RF connection having the following features:

a basic module is provided, a network module is provided, the network module has at least one network signal coupling surface, the basic module has at least one basic signal coupling surface, the network module can be positioned in or on the basic module such that a capacitive RF signal connection can be produced via the at least one network signal coupling surface and the basic signal coupling surface which can be positioned parallel to it, characterized by the following further features:

the basic module has two or more basic signal coupling surfaces, and the network module has two or more network signal coupling surfaces, the basic module has a basic ground coupling surface, the network module has a network around coupling surface, and in the operating state, the basic ground coupling surface is coupled in a floating manner to the network sound coupling surface, and is aligned parallel, wherein at least the network signal coupling surfaces are provided with small tabs or extension sections which project further at the sides, thus making it possible to achieve fine tuning of the coupling effect or matching.

12. The RF connection according to claim 11, wherein the small tabs or extension sections project sufficiently far at the sides from the network signal coupling surfaces that a coupling effect to the basic ground coupling surface is produced.

13. The RF connection according to claim 12, wherein the height of the flange sections which protrude at the sides, of the limb sections which run transversely with respect to them and of the actual base corresponds to the material thickness of the basic signal coupling surface or of the basic ground coupling surface, and of a support which is located underneath the basic signal coupling surface or, respectively, a spacer which is located underneath the basic ground coupling surface.

14. A RF or network connection having the following features:

a basic module is provided, a network module is provided, the network module has at least one network signal coupling surface, the basic module has at least one basic signal coupling surface, the network module can be positioned in or on the basic module such that a capacitive RF signal connection can be produced via the at least one network signal coupling surface and the basic signal coupling surface which can be positioned parallel to it, characterized by the following further features:

the basic module has two or more basic signal coupling surfaces, and the network module has two or more network signal coupling surfaces, the basic module has a basic ground coupling surface, the network module has a network ground coupling surface, and in the operating state, the basic ground coupling surface is coupled in a floating manner to the network ground coupling surface, and is aligned parallel, further including coaxial conductors having inner and outer conductors, and wherein in cross section, the base is at least approximately U-shaped, forming flanges which protrude at the sides and forming connecting limbs, with the connecting limbs provided at the side of the flanges which protrude at the sides and are provided at the side of the base section of the base being provided with holes, which are electrically conductively connected to the outer conductors of the coaxial conductors which are to be connected, and the inner conductors which are passed through the hole in an insulated manner are electrically connected to a respectively associated connecting section of a network signal coupling surface.

15. A RF connection having the following features:

a basic module is provided, a network module is provided, the network module has at least one network signal coupling surface, the basic module has at least one basic signal coupling surface, the network module can be positioned in or on the basic module such that a capacitive RF signal connection can be produced via the at least one network signal coupling surface and the basic signal coupling surface which can be positioned parallel to it, characterized by the following further features:

the basic module has two or more basic signal coupling surfaces, and the network module has two or more network signal coupling surfaces, the basic module has a basic ground coupling surface, the network module has a network ground coupling surface, and in the operating state, the basic around coupling surface is coupled in a floating manner to the network ground coupling surface, and is aligned parallel, wherein the network coupling surface is designed to be smaller than the basic ground coupling surface which interacts with it, with the boundary edge of the network ground coupling surface running offset with respect to the network signal coupling surfaces.

16. The RF connection according to claim 15, wherein the network signal coupling surfaces are connected via a stripline to the network which is provided on the board or on the substrate.

17. A RF connection having the following features:

a basic module is provided, a network module is provided, the network module has at least one network signal coupling surface, the basic module has at least one basic signal coupling surface, the network module can be positioned in or on the basic module such that a capacitive RF signal connection can be produced via the at least one network signal coupling surface and the basic signal coupling surface which can be positioned parallel to it, characterized by the following further features:

the basic module has two or more basic signal coupling surfaces, and the network module has two or more network signal coupling surfaces, the basic module has a basic ground coupling surface, the network module has a network ground coupling surface, and in the operating state, the basic ground coupling surface is coupled in a floating manner to the network ground coupling surface, and is aligned parallel.

wherein, the network module is fitted in or on the basic module, the network ground coupling surface resting in a directly adjacent manner on the base ground coupling surface, with the interposition of insulation or an insulating film.

18. A RF network connection having the following features:

a basic module is provided, a network module is provided, the network module has at least one network signal coupling surface, the basic module has at least one basic signal coupling surface, the network module can be positioned in or on the basic module such that a capacitive RF signal connection can be produced via the at least one network signal coupling surface and the basic signal coupling surface which can be positioned parallel to it, characterized by the following further features:

the basic module has two or more basic signal coupling surfaces, and the network module has two or more network signal coupling surfaces, the basic module has a basic ground coupling surface, the network module has a network ground coupling surface, and in the operating state, the basic ground coupling surface is coupled in a floating manner to the network ground coupling surfaces and is aligned parallel, wherein the basic signal coupling surfaces are arranged in a window or in a recess in an electrically conductive base, with the windows or recesses being designed to be at least slightly larger than the basic signal coupling surfaces which are located in them, and which is thus isolated from the basic ground coupling surface by means of a circumferential isolating gap.

19. A RF connection having the following features:

a basic module is provided, a network module is provided, the network module has at least one network signal coupling surface, the basic module has at least one basic signal coupling surface, the network module can be positioned in or on the basic module such that a capacitive RF signal connection can be produced via the at least one network signal coupling surface and the basic signal coupling surface which can be positioned parallel to it, characterized by the following further features:

the basic module has two or more basic signal coupling surfaces, and the network module has two or more network signal coupling surfaces, the basic module has a basic ground coupling surface, the network module has a network ground coupling surface, and in the operating state, the basic ground coupling surface is coupled in a floating manner to the network ground coupling surface, and is aligned parallel, wherein, in a plan view, the basic structure of the basic signal coupling surface and of the network signal coupling surface is such that the basic signal coupling surface is longer and broader than the network signal coupling surface and, in a plan view, the network signal coupling surface is located in an overlapping and embracing position.

20. A RF connection having the following features:

a basic module is provided, a network module is provided, the network module has at least one network signal coupling surface, the basic module has at least one basic signal coupling surface, the network module can be positioned in or on the basic module such that a capacitive RF signal connection can be produced via the at least one network signal coupling surface and the basic signal coupling surface which can be positioned parallel to it, characterized by the following further features:

the basic module has two or more basic signal coupling surfaces, and the network module has two or more network signal coupling surfaces, the basic module has a basic ground coupling surface, the network module has a network ground coupling surface, and in the operating state, the basic ground coupling surface is coupled in a floating manner to the network ground coupling surface, and is aligned parallel, wherein the network module is inserted into an appropriate holding area in the basic module, with the holding area in the basic module and the cross section of the network module which is inserted into it being asymmetric, so that the network module can be inserted into the basic module in only one predefined relative position.

21. An RF connection device exhibiting intermodulation levels, comprising:

a first module including a first signal coupling surface and a first ground coupling surface;

a second module including a second signal coupling surface and a second ground coupling surface, the first and second modules being positioned relative to one another to provide a capacitive RF signal connection between said first and second signal coupling surfaces without any direct electrical conductive contact therebetween, the first and second ground coupling surfaces being coupled together without any direct electrical conductive contact therebetween.

* * * * *